United States Patent [19]

Yoshiura

[11] Patent Number: 4,666,290

[45] Date of Patent: May 19, 1987

[54] CARTRIDGE LOADING DEVICE FOR A COPYING MACHINE

[75] Inventor: Shoichiro Yoshiura, Yamatokoriyama, Japan

[73] Assignee: Sharp Kabushiki Kaisha, Osaka, Japan

[21] Appl. No.: 752,858

[22] Filed: Jul. 8, 1985

[30] Foreign Application Priority Data

Jul. 9, 1984 [JP] Japan ..... 59-104590[U]

[51] Int. Cl.[4] ..... G03G 15/01; G03G 21/00

[52] U.S. Cl. ..... 355/14 D; 355/4

[58] Field of Search ..... 355/3 DD, 4, 14 D, 3 R

[56] References Cited

FOREIGN PATENT DOCUMENTS 58-163979 9/1983 Japan ..... 355/140

59-53867 3/1984 Japan ..... 355/4

*Primary Examiner*—Fred L. Braun

*Attorney, Agent, or Firm*—Birch, Stewart, Kolasch & Birch

[57] ABSTRACT

A cartridge loading device for a copying machine including a lamp which illuminates the color display unit of the copying machine; a switch that turns itself on when any of plural kinds of developer baths or toner cartridges are loaded; and a sensor that first receives reflected light from the color display unit illuminated by the lamp and then outputs signals for determining the conditions needed for correctly performing the copying process in response to the reflected light received.

8 Claims, 4 Drawing Figures

CARTRIDGE LOADING DEVICE FOR A COPYING MACHINE

BACKGROUND OF THE INVENTION

The present invention relates to a cartridge loading device built into a copying machine, more particularly, to a device for loading a cartridge into a copying machine capable of identifying the condition and color of toner in the loaded developer bath or cartridge.

Conventionally, either a developer bath or toner cartridge can be freely loaded into and unloaded from a copying machine. In addition, when performing a color copying operation by applying toners other than black, such as red, blue, and yellow, the operator can easily replace the unnecessary developer bath or toner cartridge with one containing the desired color. However, when operating any of the conventional copying machines using the method mentioned above, the operator is unable to easily identify the condition and kind of loaded developer bath or color toner cartridge.

SUMMARY OF THE INVENTION

In the light of such a disadvantage as described above, the present invention aims at providing a cartridge loading device having the capability of allowing the operator to clearly identify both the condition and the color of either developer bath or color toner cartridge loaded into a copying machine so that the operator can be prevented from incorrectly performing a copying operation using a wrong color and, in addition, the cartridge loading device embodied by the present invention automatically sets all the copying conditions in accordance with the color toners selected.

Briefly, a copying machine incorporating a cartridge loading device embodied by the present invention comprises the following: a lamp illuminating the color display unit; a switch that turns itself on when any of plural kinds of developer baths or color toner cartridges is loaded into the copying machine; and a sensor means that receives reflected light from the color display unit when the unit is illuminated by the said lamp.

Further scope of applicability of the present invention will become apparatus from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION OF THE PREFERRED EMBODIMENTS

Figure 1:
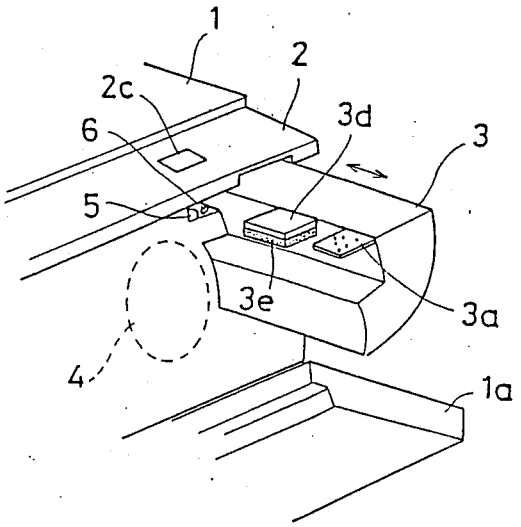
FIG. 1 is the enlarged perspective view of the main part, in which the drawn-out developer bath is shown after opening the external cover of the copying machine embodied by the present invention.
Figure 2:
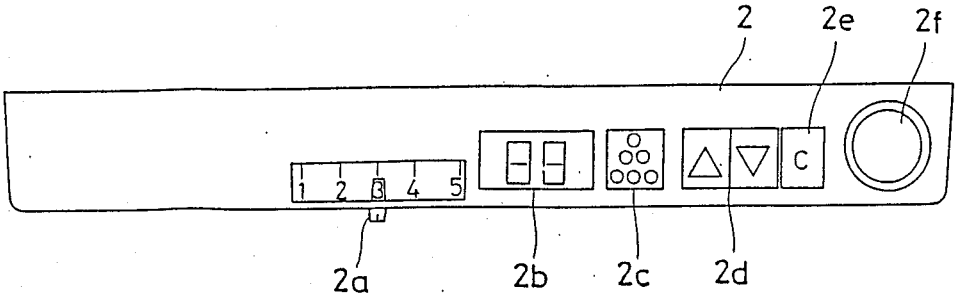
FIG. 2 is the control panel of the copying machine embodied by the present invention.
Figure 3:
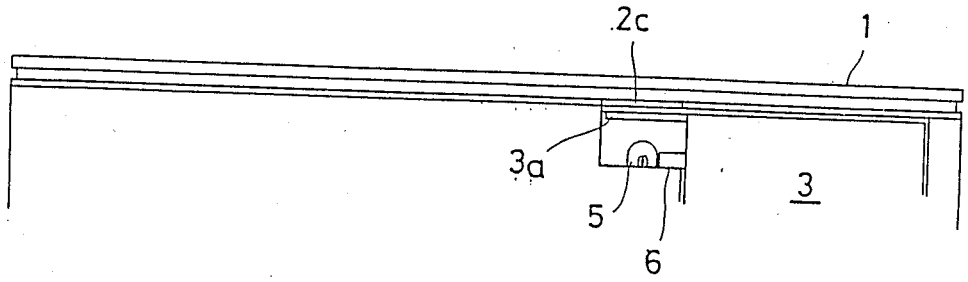
FIGS. 3 and 4 are respectively simplified configurations of the main part of the coping machine reflecting the preferred embodiments of the present invention.
Figure 4:
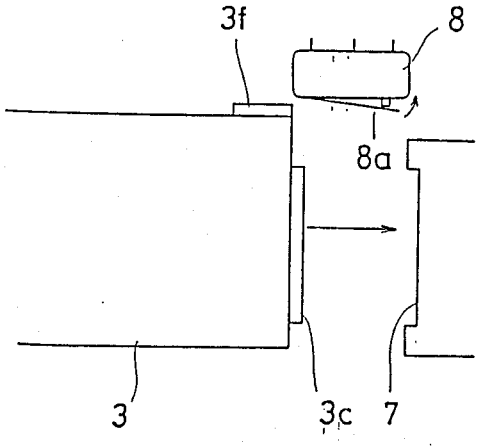

Referring now to the accompanying drawings, the preferred embodiments of the present invention are described below. FIG. 1 is an enlarged perspective view of the main part of the copying machine embodied by the present invention, from which the developer bath 3 is drawn out after opening the external cover 1 of the copying machine. The control panel 2 is provided in front of the draft-setter 1 on the upper surface of the copying machine. The control panel 2 is provided with a toner depth adjustment knob 2*a*, copied-paper number indicator 2*b*, a transparent window 2*c*, copying-paper number setter 2*d*, clear key 2*e*, and the copy-start button 2*f*, respectively. The color display unit 3*a* is installed in a position opposite from the transparent window 2*c* of the copying machine and at the upper end of the box-like developer bath 3, while the developer bath 3 is loaded in the periphery of the sensitizing drum 4. The color display unit 3*a* is composed of a selected transparent material of the same color as that of the toner stored inside and is capable of softening permanent light from the lamp 5 (to be described later on) so that there is no incident light glare when the operator visually checks through the window 2. As shown in the lateral view of FIG. 3, when the developer bath 3 is loaded, the lamp 5 illuminating the color display 3*a* and sensor means 6 that first receives reflected light from the color display unit 3*a* illuminated by this lamp and then outputs such signals for establishing the copying process condition such as exposure and developing bias voltage in response to the incoming reflected light, are respectively installed in positions immediately below the transparent window 2*c* of the copying machine. The copying machine uses a sensor means 6 that varies its own sensitivity in accordance with the colors of the reflected light. For example, when the color display unit 3*a* reflects black light, the sensor 6 delivers maximum output, while the output level lowers in the order of red and blue respectively. The developer bath 3 is loaded inside the copying machine with its convex part 3*c* coupled to the concave part 7 of the copying machine as shown in FIG. 4. This causes the convex part 3*f* come into contact with contact 8*a*, thus causing microswitch 8 to turn the lamp 5 on. A projecting flat board 3*d* is horizontally installed inside the developer bath 3, while spongy-like cleaning member 3*e* is fixed on the bottom part of the projecting flat board 3*d*. The cleaning member 3*e* moves in contact with the surfaces of lamp 5 and sensor 6 so that these surfaces can be cleaned while the developer bath 3 is in either a loaded or unloaded condition. The color display unit 3*a* inside the developer bath 3 contains the same color as that of the toner internally stored. However, independent of the stored toner color, the convex part 3*f* that activates the microswitch 8 constantly remains in the same position in relation to each toner color in the developer bath 3. The operation of the copying machine comprising the above configuration is described below.

Before starting a copying operation, a developer bath 3 containing the desired color toner is first loaded into the copying machine. This causes the convex part 3*f* to come into contact with contact 8*a* to activate microswitch 8 so that lamp 5 can light. When lamp 5 lights, light from this lamp partly passes thorough the color display unit 3*a* composed of selected semi-transparent material having the same color as that of the stored toner, thus allowing the operator to correctly identify the internal color through the window 2*c*. As a result, since the operator can confirm the condition and kind of loaded developer bath 3, he will not perform a copying operation using a wrong color. Light reflected by the color display unit 3*a* illuminated from lamp 5 is partly received by sensor 6. The output level from sensor 6 is variable according to the color content of the reflected light, i.e. by the toner color. The built-in microcomputer correctly identifies the color of toner in the developer bath 3 by referring to the output level from sensor 6 even when changing the toner color, and then determines the optimum exposure value suited for the color toner and also the optimum condition such as the developing bias voltage needed for correctly performing the copying process.

The above preferred embodiment uses a copying machine storing the desired color toner inside the developer bath 3. The present invention also covers a copying machine that loads the toner cartridge separately from the developer bath. Also, with reference to the preferred embodiment described above, a microswitch 8 is provided, which turns itself on when the developer bath 3 is loaded. This switch may also be of a non-contact photoswitch type such as a photosensor.

As is clear from the foregoing description, since the preferred embodiments of the present invention allow the operator to identify the condition of the loaded developer bath or toner cartridge as well the colors, the operator will rarely perform an incorrect copying operation through use of a wrong color. In addition, the preferred embodiments securely provide the advantages that, on receipt of the sensor output, the CPU automatically provides both the optimum exposure value suitable for the desired color toner and the optimum condition, such as the developing bias voltage, needed for correctly performing the copying process.

While only certain embodiments of the present invention have been described, it will be apparent to those skilled in the art that various changes and modifications may be made therein without departing from the spirit and scope of the present invention as claimed.

What is claimed is:

1. A cartridge loading device which accepts a plurality of kinds of developer baths or toner cartridges which can be loaded into and removed from a copying machine, said cartridge loading device only accepting and holding one developer bath or toner cartridge at a time, said developer baths or toner cartridges each having a certain color of toner or the like stored therein, said cartridge loading device comprising:

a color display unit mounted on each of said developer baths or toner cartridges, said color display unit being composed of material which is substantially the same color as the color of the toner or the like stored inside the developer bath or toner cartridge;

a light source which emits a light for illuminating the color display unit, said light source being activated when one of the developer baths or toner cartridges is loaded into the copying machine; and sensor means for receiving the light from said light source after said light has been reflected from said color display unit, said sensor means detecting the color of said color display unit and outputting signals in response to the detection of this color.

2. The cartridge loading device according to claim 1 and further comprising:

a transparent window mounted on said copying machine, said window permitting visual inspection of the color of the color display unit and thus enabling an operator to determine the color of the toner or the like stored in the developer bath or toner cartridge which is loaded into the copying machine.

3. The cartridge loading device according to claim 1, wherein said copying machine includes control means responsive to said signals, said control means including means for determining an optimum exposure valve for the color toner or the like.

4. The cartridge loading device according to claim 1, wherein said copying machine includes control means responsive to said signals, said control means including means for determining the bias voltage needed for performing a copying function.

5. The cartridge loading device according to claim 1, wherein the sensor is responsive to the reflected light in order to vary the outputted signals.

6. The cartridge loading device according to claim 1, wherein the material of said color display unit comprises semitransparent material which is capable of softening the light from said light source.

7. The cartridge loading device according to claim 1 and further comprising a cleaning member which moves into contact with the light source and the sensor means when one of the developer baths or toner cartridges is loaded and unloaded from the copying machine, said cleaning members cleaning the light source and the sensor means upon contact therewith.

8. A cartridge loading device according to claim 1 and further comprising a switch which contacts one of the developer baths or toner cartridges as it is loaded into the copying machine, said switch serving to activate said light source.

* * * * *